US006554637B1

(12) United States Patent
Yu

(10) Patent No.: US 6,554,637 B1
(45) Date of Patent: Apr. 29, 2003

(54) ELECTRICAL CONNECTOR COUPLE HAVING MATING INDICATION DEVICE

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/017,651

(22) Filed: Dec. 12, 2001

(51) Int. Cl.[7] ..... H01R 3/00
(52) U.S. Cl. ..... 439/489; 439/357
(58) Field of Search ..... 439/489, 350, 439/357, 74, 488, 660, 733.1

(56) References Cited

U.S. PATENT DOCUMENTS 3,651,446 A * 3/1972 Sadogierski et al. ..... 439/357
4,553,801 A * 11/1985 Zajeski ..... 439/357
4,938,710 A * 7/1990 Aihara et al. ..... 439/357
5,137,462 A * 8/1992 Casey et al. ..... 439/74
5,462,450 A * 10/1995 Kodama ..... 439/489
5,836,773 A * 11/1998 McHugh et al. ..... 439/74

* cited by examiner

*Primary Examiner*—Hien Vu
(74) *Attorney, Agent, or Firm*—Wei Te Chung

(57) ABSTRACT

An electrical connector couple comprises a first connector and a second connector. The first connector comprises a first insulative housing and a plurality of first contacts. The first insulative housing has two side walls with at least one wedge formed on one side wall. The second connector comprises a second insulative housing and a plurality of second contacts. A side wall is defined on the second insulative housing for engaging with the side wall having the wedge formed thereon. The side wall of the second insulative housing has a recess defined therein for receiving the wedge. When the first and second connectors are mated together completely, due to the construction of the wedge and the recess, a sound can be made by a hit of the two engaging side walls to indicate the completeness of the mating.

2 Claims, 5 Drawing Sheets

ELECTRICAL CONNECTOR COUPLE HAVING MATING INDICATION DEVICE

BACKGROUND OF THE INVENTION

1. Field of the Invention

The present invention relates to electrical connectors, especially to an electrical connector couple having mating indication device for indicating mating situation of the connector couple.

2. Description of the Related Art

Conventional board to board (BTB) connector assembly comprises a first connector and a second connector. Due to space limitation, the configuration of the BTB connector is small and this results in that housing of the BTB connector is fragile, whereby when the first and second connectors are mating, inappropriate mating force will damage the connectors. The conventional BTB connector cannot indicate the mating situation of the connectors, so there will be two undesired conditions. One condition is that the connector has mated completely, but the user does not know and still pushes the BTB connectors together. This may result in damage of contacts and even housing of the BTB connector. The second condition is that the connector has not mate completely, but the user does not know and stops pushing the BTB connectors together. This may result in failure of electrical connection between the first and second connectors.

In Taiwan Pat. Application No. 84218771, a BTB connector is disclosed, but when two such connectors are mated, the user cannot determine whether the connector couple (i.e., the two connectors) has completely mated, and this can result in the two conditions described above. Therefore, a BTB connector with mating situation indicating device is desired to overcome the shortcoming of the conventional BTB connector.

SUMMARY OF THE INVENTION

An object of the present invention is to provide an electrical connector couple having a mating indication device for indicating the mating situation of the connector couple.

In order to achieve the object set forth, an electrical connector couple in accordance with the present invention comprises a first connector. The first connector comprises a first insulative housing and a plurality of first contacts. The first insulative housing has at least two side walls with at least a wedge formed on a side wall. A second connector mated with the first connector comprising a second insulative housing and a plurality of second contacts. A side wall is defined on the second insulative housing for engaging with the side wall with the wedge formed thereon. The side wall has a recess defined therein for receiving the wedge. When the first and second connectors are mated together completely, due to the construction of the wedge and the recess, a sound can be made by a hit of the two engaging side walls to indicate the completeness of the mating.

Other objects, advantages and novel features of the present invention will be drawn from the following detailed description of a preferred embodiment of the present invention with attached drawings, in which:

DESCRIPTION OF THE PREFERRED EMBODIMENT

Figure 1:
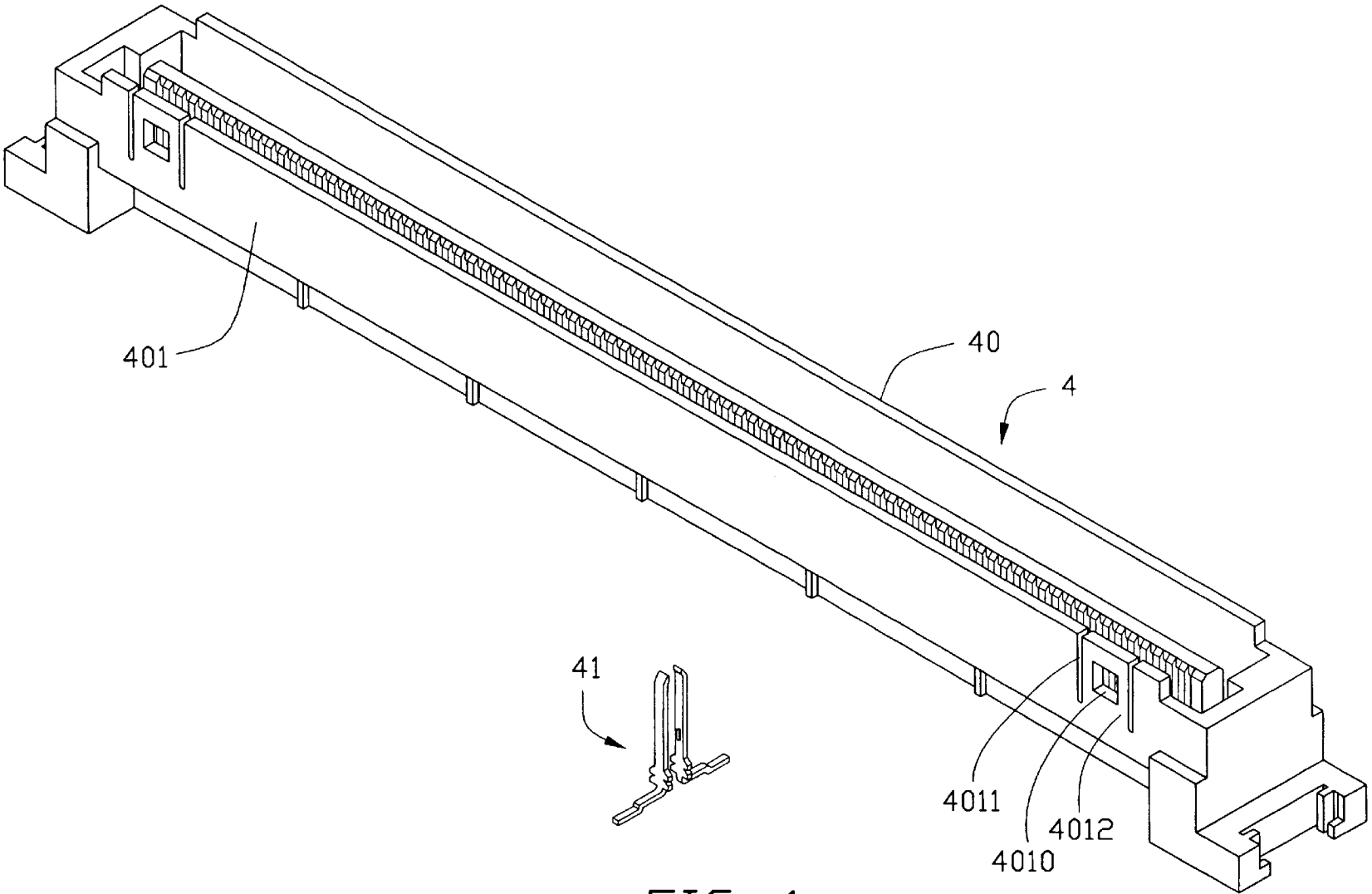
FIG. 1 is an exploded view of a second connector in accordance with the present invention.

Reference will now be made to the drawing figures to describe the present invention in detail.

Figure 2:
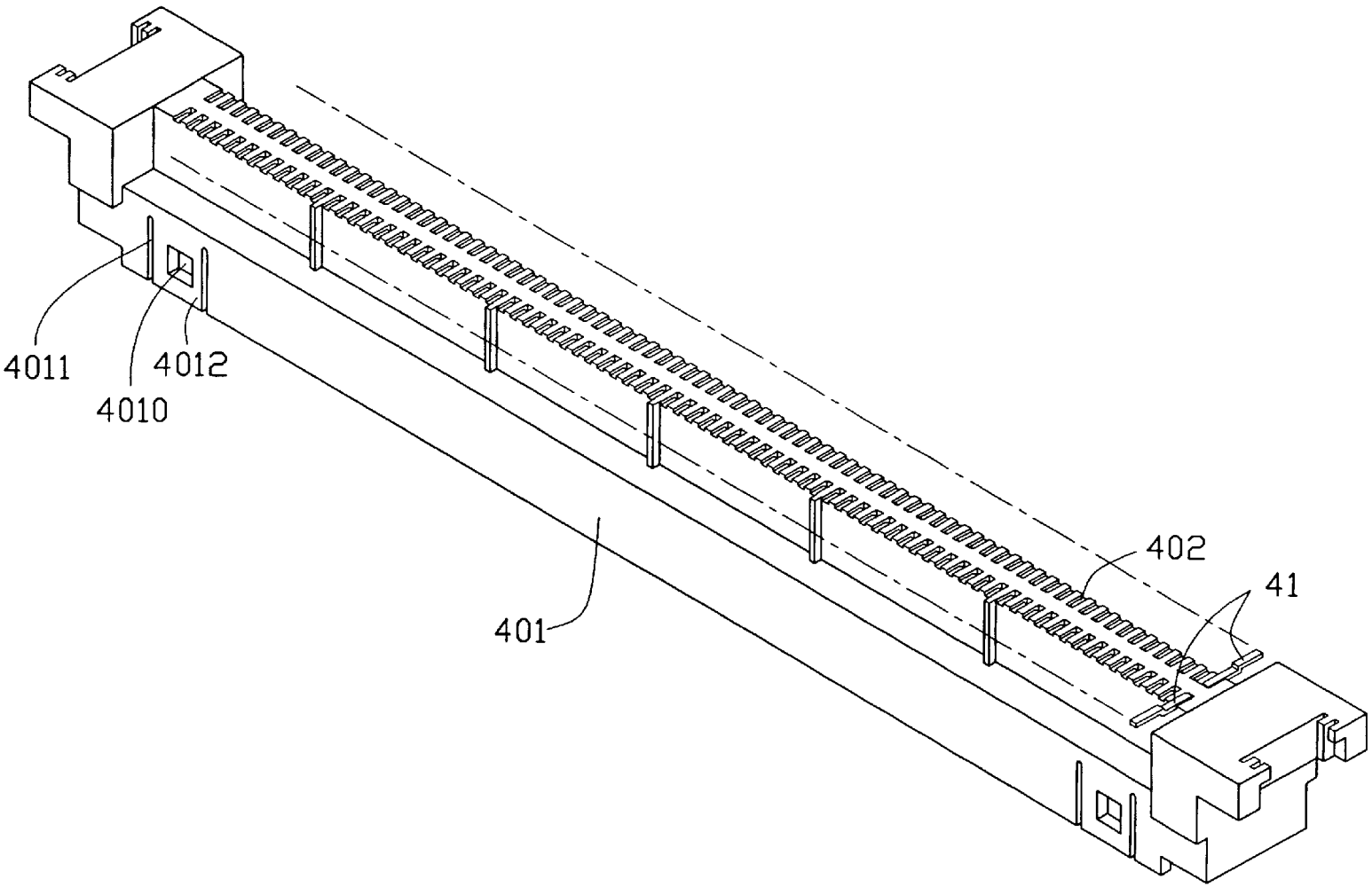
FIG. 2 is a perspective view of the second connector as viewed from a reverse direction.
Figure 3:
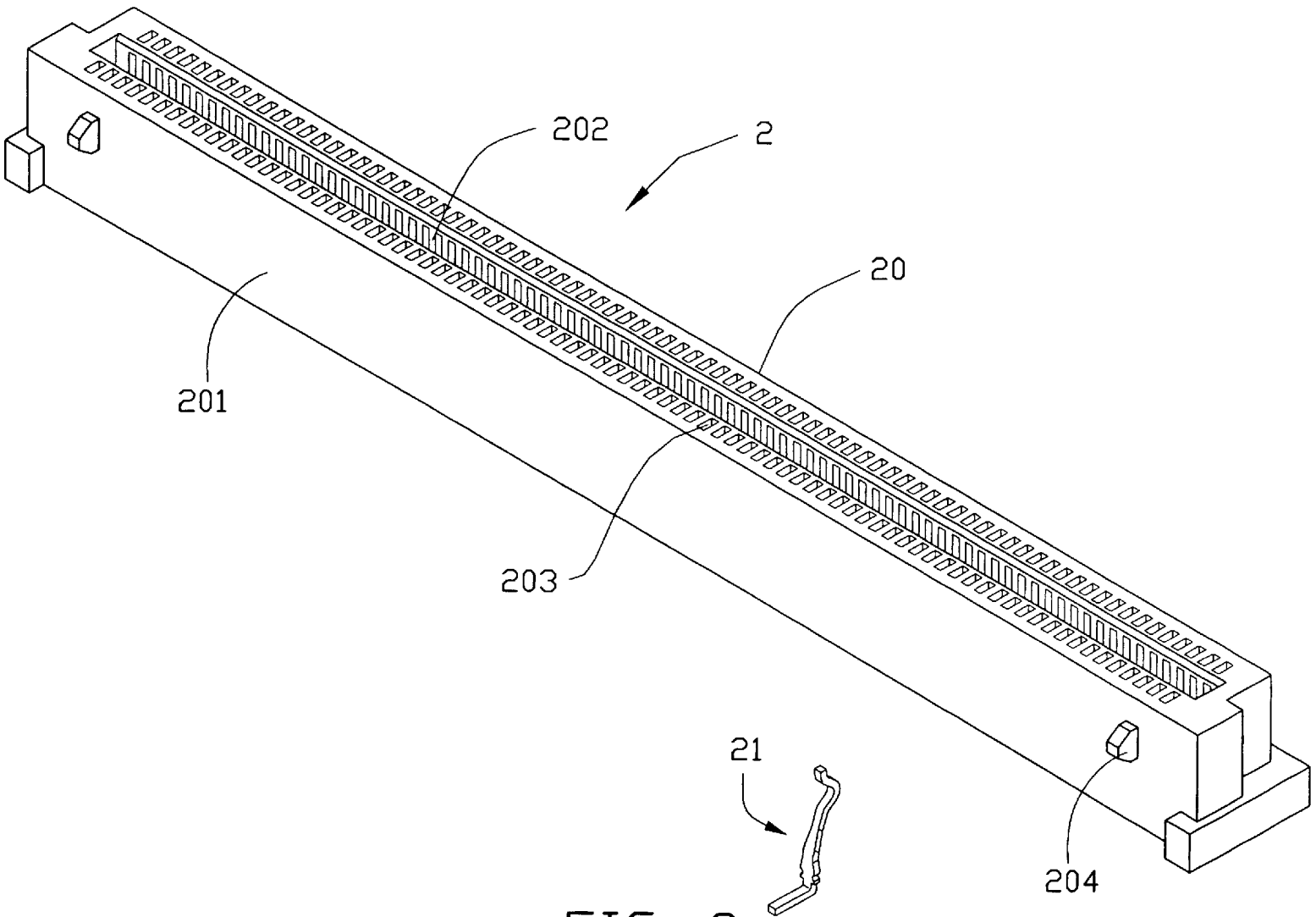
FIG. 3 is an exploded view of a first connector in accordance with the present invention.

Referring to FIGS. 1—3, a BTB electrical connector couple comprises a first connector 2 and a second connector 4. The first and second connectors 2, 4 respectively electrically connect to two printed circuit boards (not shown) for signal transmission between the two boards. The first connector 2 comprises a first insulative housing 20 and a plurality of first contacts 21 (only one contact being shown). The first insulative housing 20 has an elongated configuration with a passage 202 defined therein for mating with the second connector 4. The second connector 4 comprises a second insulative housing 40 and a plurality of second contacts 41 (only two contacts being shown). The second insulative housing 40 has an elongated configuration with contact-receiving passages 402 defined therein for securing a plurality of second contacts 41 therein.

The passage 202 of the first connector 2 has two side walls with a plurality of first contact-receiving passages 203 defined therein for receiving a plurality of first contacts 21 therein. Two first side walls 201 are defined on the first insulative housing 20, and a pair of wedges 204 are formed on the first side wall 201. The second insulative housing 40 of the second connector 4 has second side walls 401. The second side wall 401 defines a recess 4010 and two slots 4011 in opposite sides of the recess 4010. Therefore, an resilient wall 4012 is formed due to the formation of the recess 4010 and the slots 4011. During mating the second connector 4 to the first connector 2, the resilient wall 4012 will deflect outward from its original position by the wedge 204, and then return to the original position after the wedge 204 is engaged in the recess 4010 and hit on the first side wall 201 of the first insulative housing 20 of the first connector 2, whereby a sound made by the hit will indicate the completeness of the connector couple mating, and undesired damage due to the continued pressing by the user will be avoided.

Figure 4:
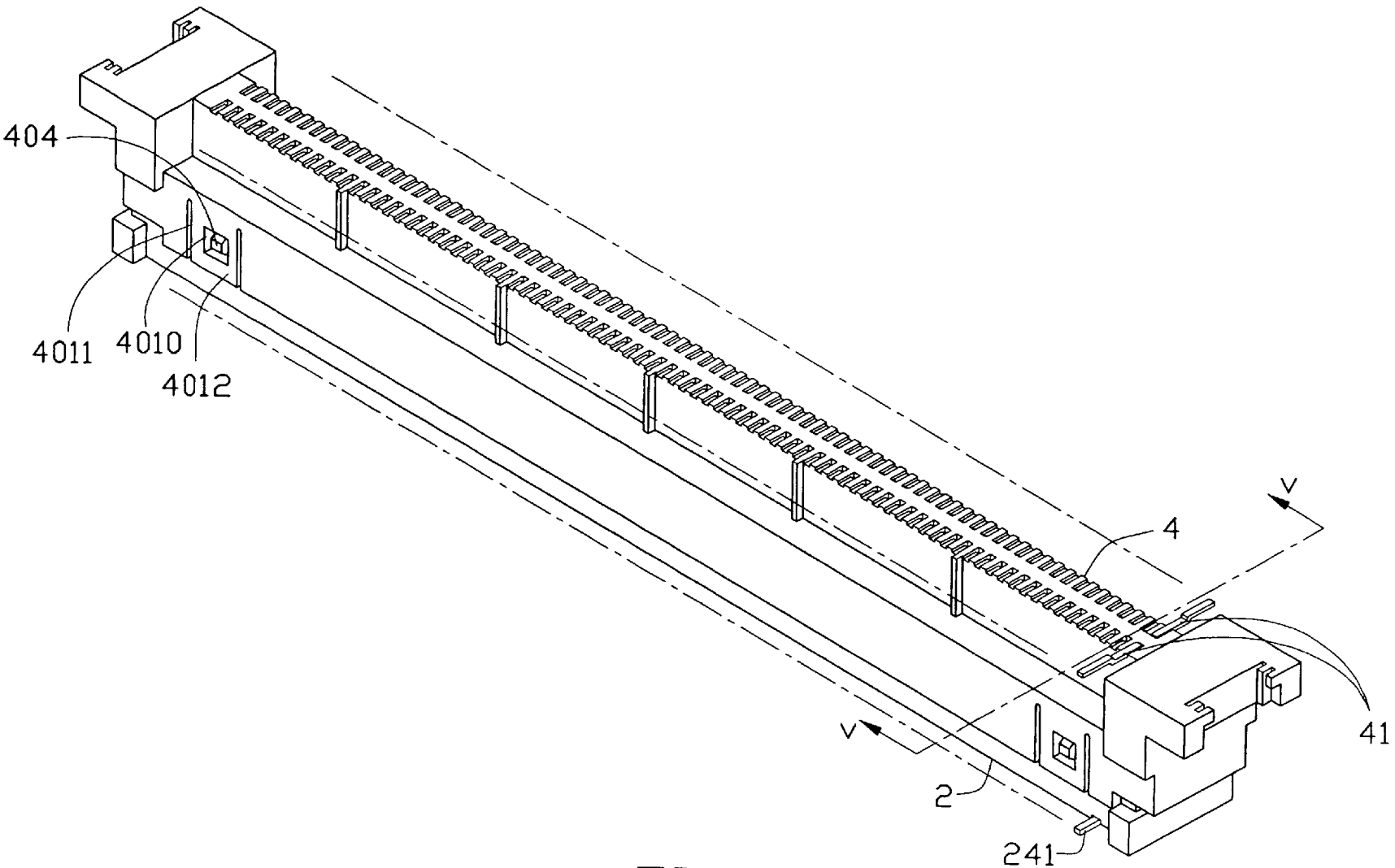
FIG. 4 is an assembled view of the first and the second connectors.
Figure 5:
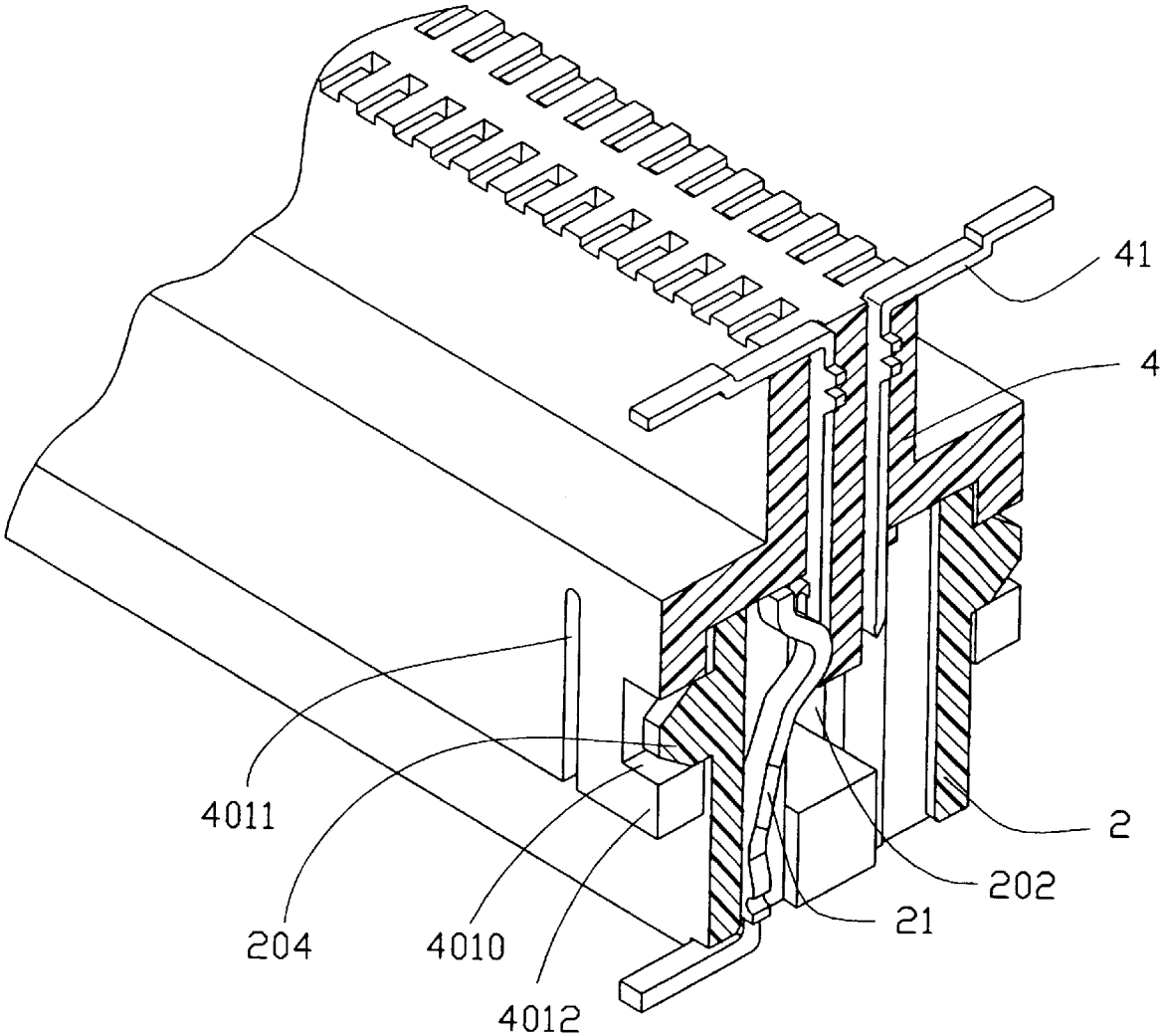
FIG. 5 is a cross sectional view taken along line V—V of FIG. 4.

Referring to FIGS. 4 and 5, the first connector 2 is mated with the second connector 4 and the first contacts 21 are electrical connected to the second contacts 41, whereby the signal will be securely transmitted.

Same to the above description, the recess 4010 and the slots 4011 formed in the first connector 2 and the wedge 204 can be formed on the second connector 4, and the mating situation indicating function can equally be archived.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector couple comprising:

a first connector comprising a first insulative housing having two side walls with a plurality of first passages for receiving a plurality of first contacts therein, one of said side walls having at least one wedge; and a second connector mated with the first connector, the second connector comprising a second insulative housing having side walls and a center elongate member with second passages for receiving a plurality of second contacts therein, one of said second side walls being engaged with the first side wall, the second side wall having at least one recess for receiving the at least one wedge, and slots at opposite sides of the recess to form a resilient wall;

wherein when mating the first and the second connectors, the wedge first deflects the resilient wall outwardly and then engages in the recess, and the resilient wall deflects back to an original position and hits the first side wall, whereby an audible indication of mating is produced.

2. The electrical connector couple as described in claim 1, wherein the recess is a through hole which is opened in the side wall of the second insulative housing.

* * * * *